US006021924A

United States Patent [19]

Suck et al.

[11] Patent Number: 6,021,924

[45] Date of Patent: Feb. 8, 2000

[54] MANUALLY CONTROLLED METERING PUMP FOR BOTTLES WITH DEFORMABLE SHEATHS

[75] Inventors: Catherine Suck, Sceaux; Pierre Bret, Vetraz-Monthoux; Jacques Pozzi, Meudon, all of France

[73] Assignee: Societe de Promotion, Recherche et Innovation Technologique, Sceaux, France

[21] Appl. No.: 08/836,349

[22] PCT Filed: Nov. 8, 1995

[86] PCT No.: PCT/FR95/01470

§ 371 Date: May 29, 1997

§ 102(e) Date: May 29, 1997

[87] PCT Pub. No.: WO96/15045

PCT Pub. Date: May 23, 1996

[30] Foreign Application Priority Data

Nov. 10, 1994 [FR] France ..... 94 13582

[51] Int. Cl.[7] ..... B65D 35/56

[52] U.S. Cl. ..... 222/105; 222/205; 222/321.7

[58] Field of Search ..... 222/95, 105, 205, 222/321.7, 321.8, 321.9, 386.5

[56] References Cited

U.S. PATENT DOCUMENTS

| | | | |
|---|---|---|---|
| 3,502,035 | 3/1970 | Fedit et al. | 222/321.9 |
| 3,949,910 | 4/1976 | Focht | 222/321.9 |
| 5,360,145 | 11/1994 | Gueret | 222/105 |
| 5,630,531 | 5/1997 | Gaucher | 222/105 |

*Primary Examiner*—Joseph A. Kaufman
*Attorney, Agent, or Firm*—Young & Thompson

[57] ABSTRACT

A manually operated metering pump for a container with a flexible body, comprising a metering chamber (20) between a lower valve (21) and an upper valve (48), a spring-biased push button (34), and a nozzle communicating with the metering chamber (20) via a central channel. The lower valve (21) is flexible and frusto-conical, and the upper valve (48) is supported on a disc (47) forming the base of a hollow rod (43) secured to the push button (34), and engages the bottom of a hollow plunger (32) operated via a push button (34).

5 Claims, 4 Drawing Sheets

MANUALLY CONTROLLED METERING PUMP FOR BOTTLES WITH DEFORMABLE SHEATHS

FIELD OF THE INVENTION

BACKGROUND OF THE INVENTION

The invention relates to a manually controlled metering pump for bottles with deformable sheaths.

Certain liquid or pasty products, particularly medications, are offered in bottles and must not be exposed to the air to keep their cleanliness or to avoid degradation. The bottles which contain them must thus have a deformable sheath, so that the volume of this sheath always corresponds to the volume of the liquid present in the bottle.

To dispense the liquid, it is known to use a screwed push button which is raised, then return it to place. It is also known to use a manually controlled pump having at its lower part an inlet ball valve and at its upper part an outlet ball valve. The pumps of this type operate correctly when maintained strictly upright.

If the bottle is on its side or inclined, the balls have the tendency to leave their conical seat and the pump does not ensure satisfactory sealing of the bottle.

There is also known from Patent Abstract of Japan, Vol. 13, No. 265, of Jun. 19, 1989 and JP-1-66,475, a metering pump adapted for very viscous fluids, comprising a metering chamber between a lower valve and an upper valve, a push button returned by a spring and a spout communicating with the metering chamber via the central channel.

The present invention has for its object to provide a pump ensuring sealing of the bottle no matter what its position.

The invention has for an object a manually controlled metering pump for a bottle with a deformable sheath, comprising a metering chamber comprised between a lower valve and an upper valve, a push button returned by a spring and a spout communicating with the metering chamber via a central channel, the upper valve being carried by a disc constituting the base of a hollow rod secured to the push button, and bearing from below on a hollow piston adapted to be driven by the push button, and sliding in the metering chamber, characterized in that the lower valve is flexible, of truncated conical shape and is maintained on the bottom of the pump by a key, in that the hollow piston has a constriction on which comes to bear a central tube carried by the push button and in that the hollow rod is enlarged below the restriction, an O-ring seal being disposed between the enlargement of the hollow rod and the constriction.

According to other characteristics of the invention:

- the hollow piston carries an O-ring to ensure sealing in the metering chamber.
- the O-ring is held in a groove carried by the hollow piston, the groove surrounds the O-ring on three sides;
- the groove maintains the O-ring from above and within it, and the O-ring is maintained from below by the edge of the disk constituting the base of the hollow rod;
- the lower valve is carried by a truncated conical portion of the bottom of the pump.

BRIEF DESCRIPTION OF THE DRAWINGS

Other characteristics will appear from the description which follows with reference to the accompanying drawing, on which can be seen.

DETAILED DESCRIPTION OF THE INVENTION

Figure 1:
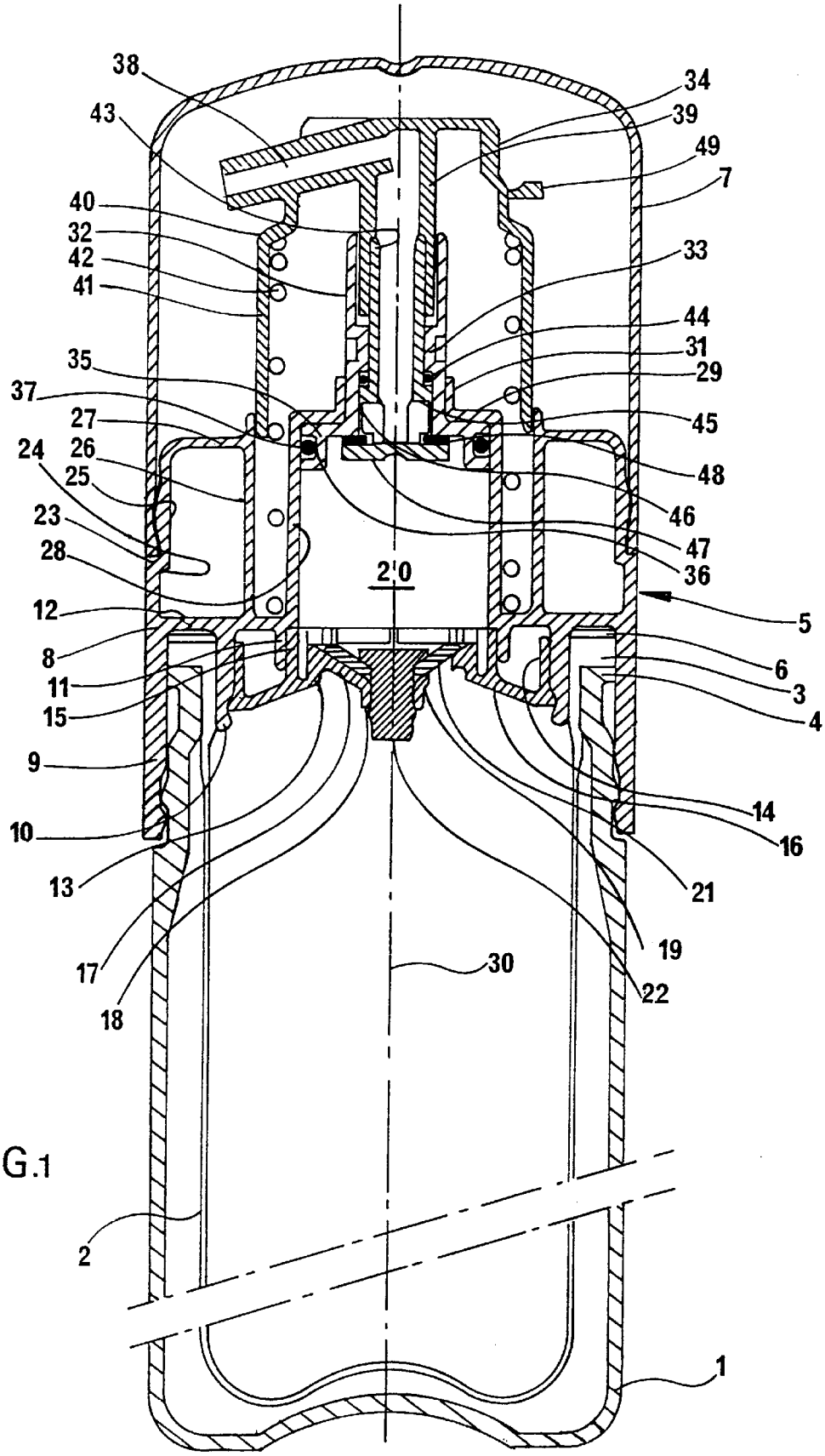
FIG. 1—a cross-sectional view of a bottle with a deformable sheath provided with a pump according to the invention.

In FIG. 1, the bottle provided with the pump according to the invention comprises a rigid external sheath 1 and a deformable internal sheath 2 disposed within the rigid sheath 1. The neck 3 of the deformable envelope 2 is disposed on the neck 4 of the rigid sheath 1. A metering pump 5 is provided on the sheaths 1 and 2 of the bottle with the interposition of a neck joint 6. A protective cap 7 is disposed on the pump 5.

The pump 5 comprises a body 8 having an external cylindrical skirt 9 adapted to have snap fitting with the exterior of the rigid sheath 1 of the bottle, and intermediate skirt 10 being applied to the interior of the deformable internal sheath 2 of the bottle, and an internal skirt 11. The three coaxial skirts are carried by a flat ring 12 which bears on the neck joint 6 to compress it to ensure sealing between the interior of the deformable sheath 2 and the exterior of the bottle.

Below the flat ring 12 is disposed a bottom 13 of the pump 5. This bottom 13 comprises an external cylindrical wall 14 bearing on the interior of the intermediate skirt 10 and an internal cylindrical wall 15 bearing on the interior of the internal skirt 11 of the body 8 of the pump 5. These two walls 14 and 15 are connected by a truncated conical portion 16 that opens downwardly, and whose external edge projects slightly relative to the external wall 14 to coact with a groove presented by the intermediate skirt 10 so as to ensure the blocking in position of the bottom 13 on the body 8. The truncated conical portion 16 is prolonged inwardly by another truncated conical portion 17 that opens upwardly and has a central opening 18. The truncated conical portion 17 of the bottom 13 moreover has at least one opening 19 adapted to place the interior of the deformable sheath 2 into communication with the metering chamber 20 disposed above the bottom 13.

On the truncated conical portion 17 that opens upwardly, is disposed a lower flexible truncated conical valve that is maintained bearing against the bottom 13 by a key 22 passing through the valve 21 and the central opening 18 of the bottom 13.

This valve 21 closes the opening 19 of communication between the internal sheath 2 of the bottle and the metering chamber 20 of the pump.

Above the flat ring 12, the body 8 of the pump 5 has, from the exterior toward the interior, three coaxial walls: an external wall 23 extending in prolongation of the external skirt 9, then after a constriction 24, extending via a cylindrical portion 25 provided with an annular rib outwardly to coact with the cap 7 to ensure its holding; an intermediate wall 26, connected at least partially to the external wall 23 at its upper portion by radial arms 27; and an internal wall 28 substantially at the same height as the intermediate wall 26.

At its upper portion, the internal wall 28 carries a flat ring 29 which extends toward the axis 30 of the bottle, and is prolonged by a cylindrical wall 31 extending upwardly.

This cylindrical wall 31 serves as a guide for the piston 32 of the pump 5. This piston 32 is cylindrical and hollow. It has at about the middle of its height, a constriction 33 adapted to serve to bear on the push button 34 of the pump 5. It carries at its base an annular enlargement 35 adapted to come into bearing against the flat ring 29. Below this enlargement 35 is disposed an annular groove 36 in which is disposed an O-ring 37 ensuring sealing against the internal wall 28.

The push button 34 is comprised essentially of a spout 38 at its upper portion, a central tube 39 and a bell 40, coaxial with the central tube 39. This bell 40 has a cylindrical skirt 41 adapted to slide within the intermediate wall 26. The bell 40 is urged upwardly by a spiral spring 42, which extends from the upper portion of the bell 40, to the interior of the skirt 41 of the bell 40, toward the exterior of the internal wall 28, to the flat ring 12 on which it bears.

The central tube 39 is adapted to slide within the piston 32 until it enters into contact with the constriction 33. It carries at its interior a hollow rod 43, which is secured to the central tube 39. The rod 43 slides within the constriction 33 of the piston 32. It is enlarged below the constriction 33 and between its enlargement 45 and the constriction 33 is disposed a sealing O-ring 44. Below its enlargement 45, the hollow rod 43 has lateral openings 46 adapted to establish communication between the interior of the rod 43 and the exterior.

At its lower end, the rod 43 carries a disk 47 on which is disposed an upper valve 48 of annular shape, which bears below the enlargement 35 of the piston 32.

At the level of the lower portion of the spout 38, the bell 40 carries externally a ring 49. Between this ring 49 and the upper portion of the intermediate wall 26, is provided a tear-off cylindrical collar, not shown, adapted to guarantee non-use of the pump if it has not been removed.

When the pump 5 is at rest, it is in the position shown in FIG. 1. The push button 34 is in raised position, the upper valve 48 is closed, the central tube 39 does not bear against the constriction 33 of the piston 32 but is slightly above it, the enlargement 35 of the piston 32 bears below the flat ring 29, and the lower valve 21 is closed. The metering chamber 20 is defined by the space comprised between the upper valve 48 and the lower valve 21 within the internal cylindrical wall 28.

Figure 2:
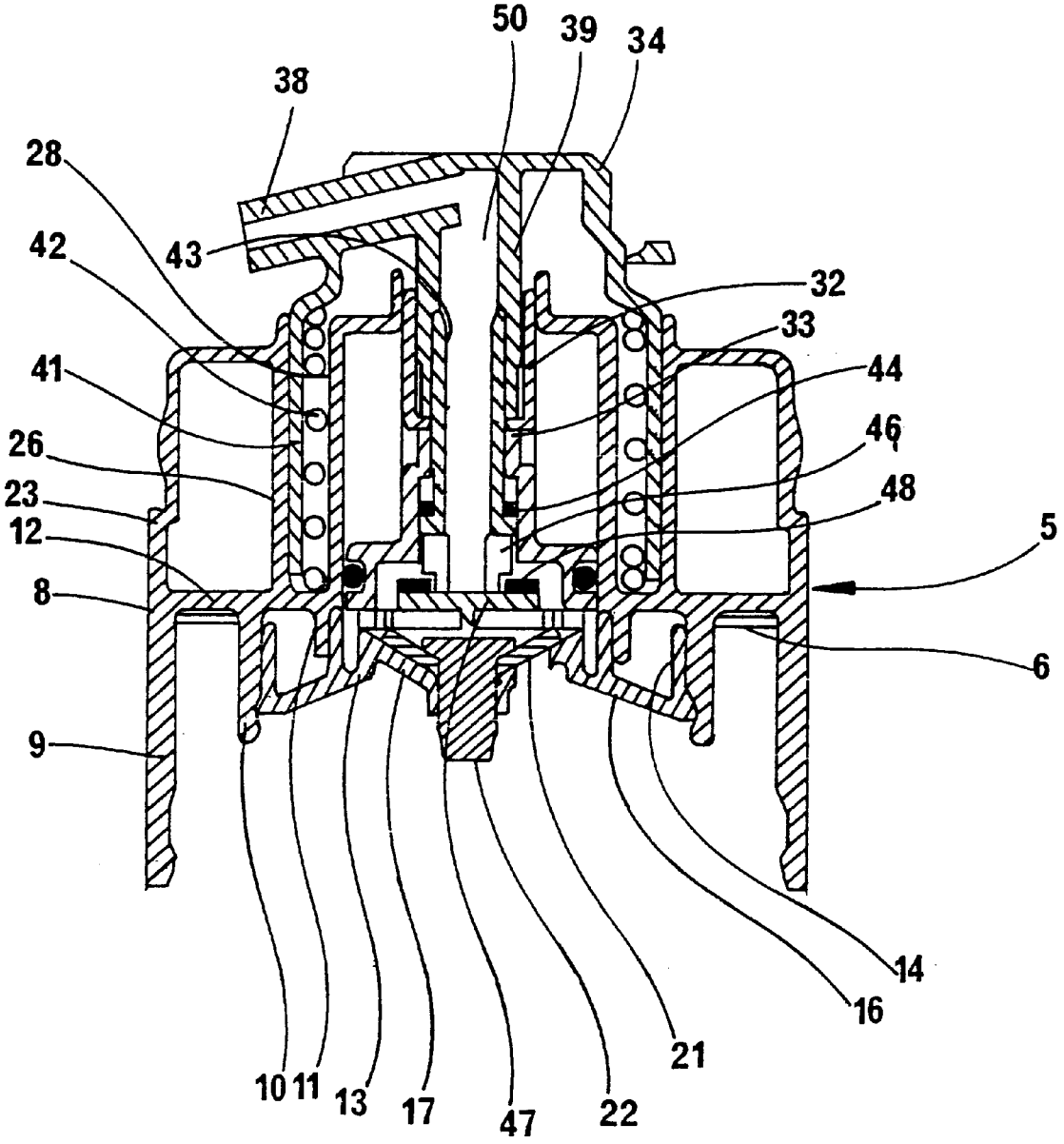
FIG. 2—a cross-sectional view of the pump of FIG. 1 at the end of pumping for expelling liquid.

In FIG. 2, the pump 5 is shown at the end of a pumping stroke. The disk 47 is in the lowered position at the level of the flat ring 12, the upper valve 48 is open, the openings 46 of the hollow rod 43 are exposed, and the product contained in the metering chamber 20 of FIG. 1 has been conveyed toward the spout 38 by the central channel 50 of the rod 43 of the tube 39.

Starting with the position of FIG. 1, the operation of the pump according to the invention is as follows: manual pushing on the push button 34 causes the central tube 39 to descend until it bears against the restriction 33 of the piston 32. In the course of this descent, the upper valve 48 opens and the product contained in the chamber 20 commences to pass through the openings 46 of the rod 43 toward the central channel 50. The downward movement of the push button 34 continues, driving the piston 32, which slides in the cylindrical wall 31. The cylindrical skirt 41 of the bell 40 slides within the intermediate wall 26 and the spring 42 is compressed. During the downward movement of the piston 32, the product contained in the chamber 20 flows through the openings 46, the central channel 50 and the spout 38.

At the end of the downward movement, manual pressure on the push button is released and the spring 42 causes the push button 34 to rise again, driving the rod 43 with which it is fixed. The upper valve 48 closes and the rising of the push button 34 causes the rising of the piston 32 by the pressure of the valve 48 below the annular enlargement 35 of the piston 32. The lower valve 21 opens and the product contained in the deformable sheath 2 then rising into the chamber 20, the decrease of corresponding volume giving rise to a corresponding deformation of the deformable sheath 2. When the push button 34 has returned to its initial position of FIG. 1, the lower valve 21 closes.

Figure 3:
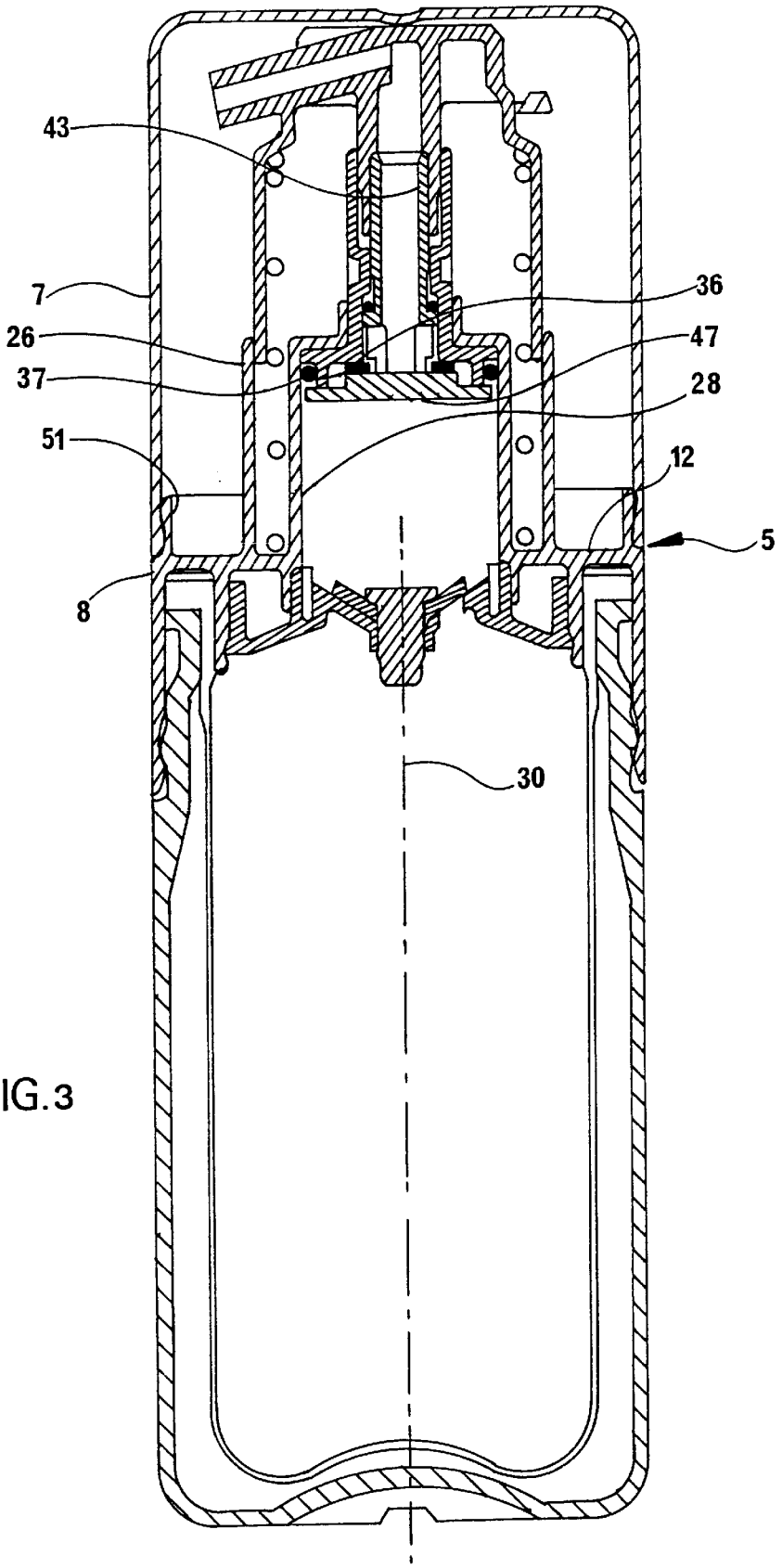
FIG. 3—a cross-sectional view of a modified embodiment of a model with a deformable sheath provided with a pump according to the invention.

In the embodiment of FIG. 3, certain details are modified relative to FIG. 1. Thus, above the flat ring 12, the body 8 of the pump 5 again has three coaxial walls, but if the intermediate wall 26 and the internal wall 28 are identical to those of FIG. 1, the external wall 51 is modified relative to the wall 23 of FIG. 1. The wall 51 is flared toward the axis 30 of the pump 5 and its external edge is shaped to receive the protective cap 7. Moreover, this wall 51 is not connected to the intermediate wall 26.

Another modification relates to the groove 36 for maintaining the O-ring 37. In FIG. 1, this groove 36 surrounds the O-ring on three sides. In the embodiment of FIG. 3, the groove 36 maintains the O-ring 37 only on two sides: above and from within. The underside of the O-ring 37 is maintained by the external edge of the disk 47 constituting the base of the rod 43. This arrangement permits avoiding a two-part mold for the production of piston 32 which carries the O-ring 37, which avoids flash at the mold joint, from the opening and closing of the mold, in the groove of the O-ring, and thus improves the seal at this joint.

Figure 4:
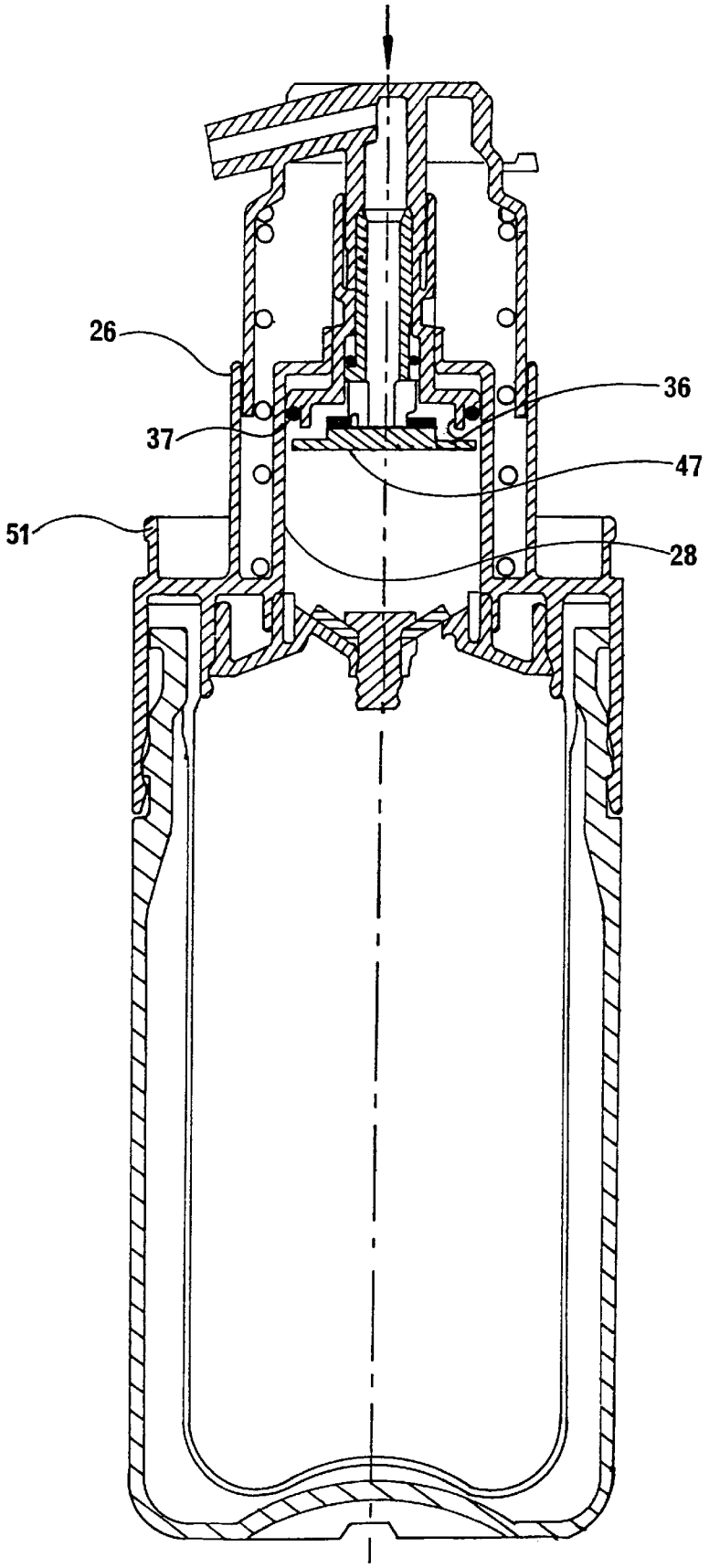
FIG. 4—a cross-sectional view of the pump of FIG. 3 in the course of pumping.

In FIG. 4, the relative positions of the O-ring 37, the groove 36 and the disk 47 are easily visible. The disk 47 is fairly wide to drive the O-ring 37 during rising of the push button, but it lets pass about itself the product which flows toward the central channel 50.

The operation of the pump according to FIGS. 3 and 4 is identical to that of the pump of FIGS. 1 and 2.

The pump according to the invention has been described in the case of a bottle with a deformable wall. Its operation is identical in the case of a bottle with a piston rising in a cylindrical sheath 2 to preserve the product from contact with the air.

We claim:

1. Manually controlled metering pump for a bottle with a deformable sheath, comprising a metering chamber disposed between a lower valve and an upper valve, a push button urged by a spring and a spout communicating with the metering chamber via a central channel, the upper valve (48) being carried by a disk (47) constituting the base of a hollow rod (43) secured to the push button (34), and bearing below a hollow piston (32) adapted to be driven by the push button (34), and sliding in the metering chamber, characterized in that the lower valve (21) is flexible, of truncated conical shape and is maintained on the bottom of the pump by a key, in that the hollow piston (32) carries a constriction (33) onto which comes to bear a central tube (39) carried by the push button (34), and in that the hollow rod (43) is enlarged below the constriction (33), a sealing O-ring (44) being disposed between the enlargement (45) of the hollow rod (43) and the constriction (33).

2. Pump according to claim 1, characterized in that the hollow piston (32) carries an O-ring (37) to ensure sealing in the metering chamber.

3. Pump according to claim 2, characterized in that the O-ring (37) carried by the hollow piston (32) is held in a groove (36) carried by the hollow piston (32).

4. Pump according to claim 3, characterized in that the groove (36) surrounds the O-ring (37) on three sides.

5. Pump according to claim 3, characterized in that the groove (36) maintains the O-ring (37) from above and from within, and from below the O-ring is maintained by the edge of the disk (47) constituting the base of the hollow rod (43).

* * * * *